US005313221A

United States Patent [19]

Denton, Jr.

[11] Patent Number: 5,313,221

[45] Date of Patent: May 17, 1994

[54] SELF-DEPLOYABLE PHASED ARRAY RADAR ANTENNA

[75] Inventor: Robert J. Denton, Jr., Rome, N.Y.

[73] Assignee: The United States of America as represented by the Secretary of the Air Force, Washington, D.C.

[21] Appl. No.: 902,107

[22] Filed: Jun. 22, 1992

[51] Int. Cl.[5] ..... H01Q 1/48

[52] U.S. Cl. ..... 343/846; 343/881; 343/888

[58] Field of Search ..... 343/846, 877, 825, 826, 343/827, 829, 848, 880, 881, 900, 888; H01Q 1/48

[56] References Cited

U.S. PATENT DOCUMENTS

| | | | |
|---|---|---|---|
| 1,689,400 | 3/1922 | Manley | 343/866 |
| 1,696,402 | 8/1924 | Horton | 343/866 |
| 3,509,570 | 4/1970 | Lindsey et al. | 343/888 |
| 3,978,410 | 8/1976 | Fletcher et al. | 343/705 |
| 4,220,956 | 9/1980 | Sanford | 343/806 |
| 4,412,221 | 10/1983 | Stapleton | 343/708 |

*Primary Examiner*—Donald Hajec
*Assistant Examiner*—Hoanganh Le
*Attorney, Agent, or Firm*—Stanton E. Collier; Donald J. Singer

[57] ABSTRACT

A phased array monopole antenna has a single layer membrane upon which a plurality of antenna units are attached. Each antenna unit has a flexible curved antenna blade which bends over or springs up when the membrane is rolled or unrolled on a drum.

2 Claims, 2 Drawing Sheets

SELF-DEPLOYABLE PHASED ARRAY RADAR ANTENNA

STATEMENT OF GOVERNMENT INTEREST

The invention described herein may be manufactured and used by or for the Government for governmental purposes without the payment of any royalty thereon.

BACKGROUND OF THE INVENTION

The present invention relates to phased array radar technology, and, more particularly, relates to a space-fed phased array radar antenna employing the window shade deployment technique for use in a space-based radar.

The current state-of-the-art technology includes a window shade deployed space-fed phased array radar antenna which is particularly suited for use in space. The rolled antenna is advantageous because it minimizes storage space aboard a spacecraft, such as a satellite, where available space is at a minimum. This is because, when in a stowed position, it minimizes the amount of space required in a launch vehicle. When the spacecraft achieves a selected orbit, the antenna is deployed and the window shade structure is unrolled to a fully expanded operative condition. Such an antenna may consist of a low to medium power RF feed which illuminates a lens aperture membrane. Active transmit/-receive (T/R) modules in the aperture membrane receive radar pulses from the feed, perform beam-steering phase shifts, amplify them and re-transmit the signal towards a target of interest on the ground or in the air.

The reflected energy is received in reverse order, being amplified by the T/R modules and then focused back into the space feed. Radar processors and the supporting subsystems are part of the satellite bus and may be located in the feed or at the base of a feed mast. In line with current technology, the aperture consists of a tensioned membrane consisting of three separate equally spaced layers, which provides for a very lightweight, yet sufficiently flat, aperture plane. Array flatness requirements for the space-fed approach are less severe than for corporate-fed approaches by an order of magnitude. The membrane aperture can be rolled up onto a drum, resulting in a simple, compact, and repeatable method for deployment and retraction of the antenna.

Although this technique may seem appropriate, there are several potential problems with the technology. First of all, although the three-layer membrane conforms to the weight and flatness requirements necessary for a space-fed lens space-based radar, it is extremely complex to manufacture. This is due primarily to the three separate layers inherent in the design, as well as the many different parts and connections necessary between these parts. The layers are equally spaced on depoloyment (separated by $\frac{1}{4}$ wavelength) and come together when stowed. Electronics embedded in the middle layer must be connected to the antenna elements on the outside layers. This also adversely affects the performance reliability of the radar. Another area of concern is the type of antenna radiating element used—a dipole. The antenna pattern of a monopole is much more applicable for a space-based radar mission. Thus, there is a need to develop a monopole antenna structure for use in space-based radars.

SUMMARY OF THE INVENTION

The present invention provides a phased array monopole antenna for use in a space-based radar design, incorporating a space-fed aperture membrane.

The invention comprises a flexible single-layer membrane, (This single layer may and generally will be a composite of several layers of material) upon which are mounted a plurality of monopole antenna units. Each of these antenna units has a ground plane, an antenna mounting base mounted thereon, and a flexible monopole antenna blade mounted in the base. In actuality, the ground planes of each of the antenna units would form one large, common ground plane. The antenna may be connected to a RF connector or directly into a T/R module, as in the space-fed arrangement previously discussed. The membrane with these monopole antenna units thereon may be rolled up or rolled out using a window shade-like apparatus. The antenna blades, which are perpendicular to the membrane, bend over upon retraction of the membrane and spring up upon deployment of such.

Therefore, one objective of the present invention is to provide an improved space-based radar antenna using monopole antennae.

Another objective of the present invention is to provide a phased array antenna structure using monopole antennae.

Another objective of the present invention is to provide an improved antenna structure having monopole antennae and a single-layer membrane for support thereof.

Another objective of the present invention is to provide an improved antenna structure wherein the antenna blade self-deploys and/or retracts with the deployment/retraction movement of the membrane.

Another objective of the present invention is to provide an improved antenna structure having fewer electrical connections and simpler construction considerations.

These and many other objectives and advantages of the present invention will be readily apparent to on skilled in the pertinent art from the following detailed description of a preferred embodiment of the invention and the related drawings.

DESCRIPTION OF THE PREFERRED EMBODIMENT

Figure 4:
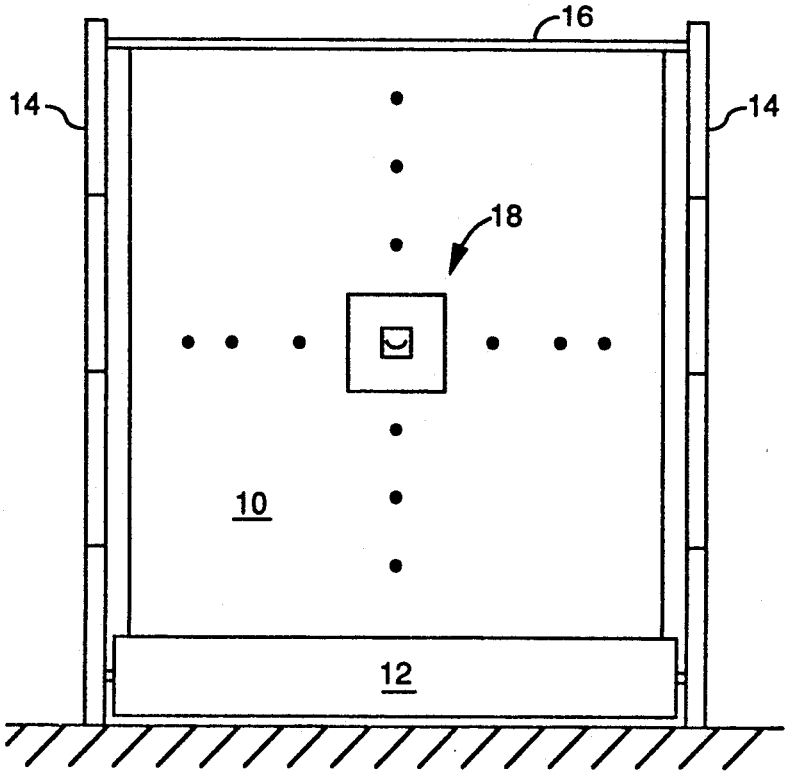
FIG. 4 illustrates the deployment of the present invention by the window shade technique.

Referring to FIG. 4, a flexible single layer membrane 10 is shown partially deployed. The membrane 10 is stored on a drum 12 that operates like a window shade. Electromechanically operated telescoping towers 14 have a cross beam 16, attached thereon which is attached to the membrane 10. As the towers 14 telescope out, the beam 16 pulls the membrane 10 from the drum 12. Upon retraction, the drum 12 may be spring loaded to rewind the membrane 10. U.S. Pat. Nos. 4,220,956; 1,696,402; and 1,689,400 are incorporated by reference.

Figure 1:
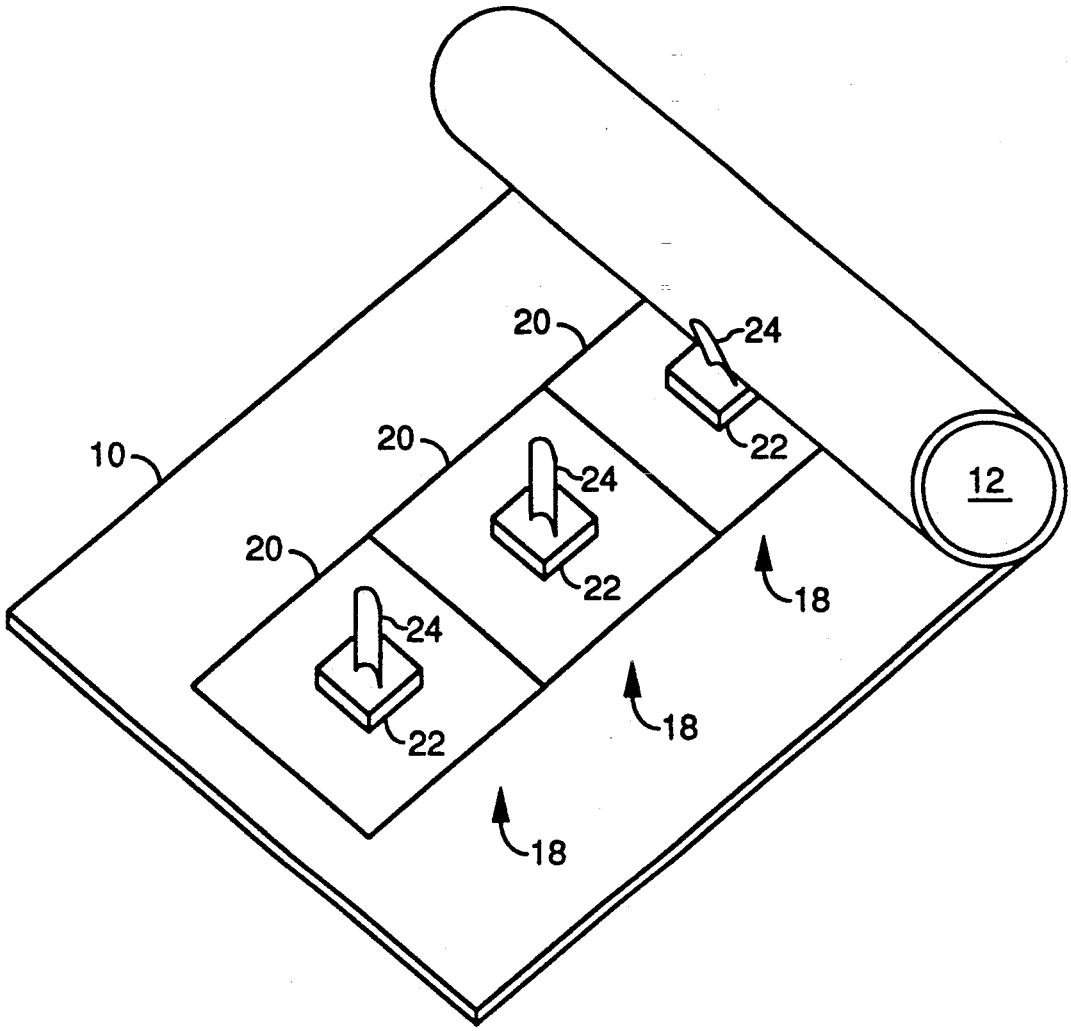
FIG. 1 illustrates, by perspective view, the present invention.

Referring to FIG. 1, a plurality of antenna units 18 are attached to the membrane 10, in a desired pattern, to produce a phased array antenna. Each antenna unit 18 is composed of a ground plane 20, an antenna mounting base 22, and a monopole antenna blade 24.

Figure 3A:
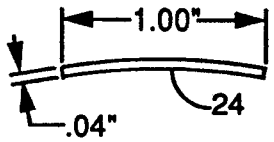
FIG. 3A is a top view of the antenna blade showing its curvature.
Figure 3B:
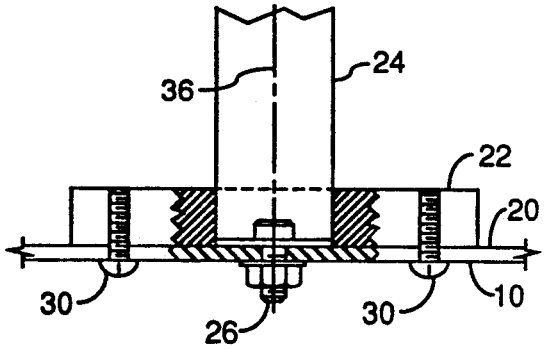
FIG. 3B is cross section through the antenna mounting base with the antenna blade mounted thereon of the present invention.

FIGS. 3A and 3B illustrate, by cross section, showing the antenna blade 24 connected to an RF connector 26.

Figure 2:
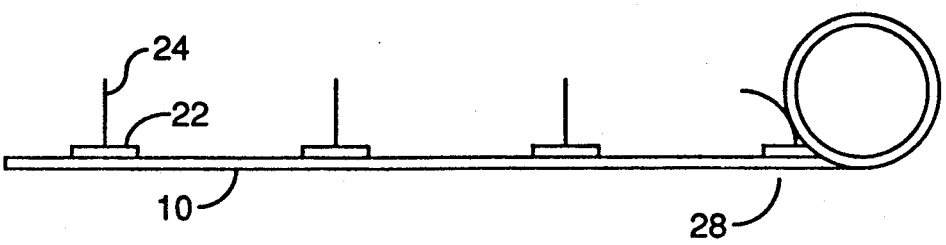
FIG. 2 is a side view of the present invention.

The antenna blade 24 is the actual radiating element of a radar system. The length and width of the blade 24 can be adjusted for efficient radiation at the frequency desired. The antenna blade 24 is curved along its major axis 36 which is perpendicular to the membrane 10 when deployed. This curvature provides for rigidity when deployed with the radius of curvature being a function of the material used and the stiffness required. The blade 24 folds down when the membrane 10 retracts, i.e., the blade 24 bends over and rolls around the membrane drum 12 when pressure is applied to it during the retraction phase of the membrane 10 such that the blade 24 will be pushed toward the concave side of the blade 24. See blade 28 in FIG. 2. When the pressure on the antenna blade is released, the reverse process will occur and the blade 24 will spring up when the membrane 10 deployment occurs. The curvature allows the antenna blade 24 to be semi-rigid in a deployed mode without inhibiting the ability of the blade 24 to fold down when the membrane 10 rolls up during retraction.

Figure 3C:
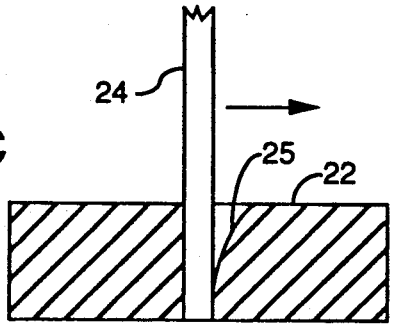
FIG. 3C illustrates the antenna blade counter-sunk in the antenna mounting base with a bending surface therein.

The antenna blade 24 is mounted to the antenna mounting base 22. The purpose of the antenna mounting base 22 is to cushion the blade 24 during the bending that occurs as it folds down during the membrane 10 retraction phase. The antenna blade 24 is counter-sunk in the antenna mounting base 22 such that the antenna blade 24 is not bent with a sharp 90 degree bend. Referring to FIG. 3C, the antenna blade 24 is shown mounted in the antenna base 22 with a bending surface 25 therein. When the antenna blade 24 is pushed in the direction of the arrow, the blade 24 will smoothly bend along the bending surface 25 to prevent kinks in the blade 24.

The antenna blade 24 was made of phosphor brass for the prototype model that was built. However, metallized Kevler could be used instead, as well as any other stiff, light weight material that can be metallized and used in this mode. The antenna mounting base 22 was made of plexiglass in the prototype. However, the material is arbitrary. For instance, a light weight, semi-rigid foam could have been used instead.

The antenna mounting base 22 also serves to relieve strain on the RF connector 26. However, in the preferred embodiment of the antenna unit, i.e., the antenna unit 18 is integrated directly into a T/R module, not shown. This connector 26 would be replaced with an RF transmission line such as a strip line or a microstrip feed.

The antenna ground plane 20 is connected to the antenna blade 24 physically through the antenna mounting base 22 and electrically soldered to the center conductor of the RF connector 26.

The physical connection of the antenna mounting base 22 to the antenna ground plane 20 is accomplished in FIG. 3B through four screws 30. However, these are simply attachment points. The screws can be replaced with rivets, bolts, or some form of adhesive.

Compared to the current state-of-the-art technology, which incorporates a dipole antenna mounted on a three-layer membrane, the present invention combines the advantages of a monopole antenna with the unique features of a single-layer membrane 10.

The use of a monopole antenna has advantages for a space-based radar mission, particularly because the antenna pattern of a monopole radiator is better suited than that of a dipole for a space-based radar in an earth orbit. The problem with a monopole has always been how to deploy and retract the antenna once the window shade membrane has unrolled. It should be noted that the monopole antenna described herein is better suited for the earth side of the phased array only. It is still necessary to use a patch radiator or similar printed element on the feed side.

The use of the single-layer membrane 10 greatly reduces the complexity over the three-layer membrane currently in use. With the three-layer membrane, there are two RF connections and a power connection to each T/R module. The present invention can be integrated directly into the T/R modules, thus eliminating the RF connections. The fewer number of parts in a single-layer membrane, along with the smaller number of connections necessary between these parts not only simplifies the manufacturability, but it also simplifies the testing of the completed product as well as improving its performance reliability.

Clearly, many modifications and variations of the present invention are possible in light of the above teachings and it is therefore understood, that within the inventive scope of the inventive concept, the invention may be practiced otherwise than specifically claimed.

What is claimed is:

1. An improved space-based phased array radar, said improvement comprising:

means for deployment of an antenna, said antenna stored upon a drum within said means for deployment;

said antenna comprising:

a flexible membrane, said membrane being a space-fed aperture membrane; and a plurality of antenna units each antenna unit comprising;

a ground plane, said ground plane attached to said membrane;

an antenna mounting base, said mounting base fixedly connected to said ground plane; and an antenna blade, said blade being a monopole radiator, said antenna blade being curved about an axis perpendicular to the ground plane, said antenna blade being made of a flexible material whereby said blade bends over when said membrane is rolled onto said drum and said blade springs up when said membrane is unrolled from said drum.

2. An improved spaced-based radar array as defined in claim 1 wherein said antenna is deployed/retracted by means of a window shade technique.

* * * * *